US006039308A

United States Patent [19]

Venegas, Jr.

[11] Patent Number: 6,039,308

[45] Date of Patent: Mar. 21, 2000

[54] PEOPLE GATE

[76] Inventor: Frank Venegas, Jr., 5682 Lakeridge Dr., Brighton, Mich. 48116

[21] Appl. No.: 09/033,135

[22] Filed: Mar. 2, 1998

Related U.S. Application Data

[63] Continuation-in-part of application No. 08/870,101, Jun. 5, 1997.

[51] Int. Cl.[7] ..... E04H 17/14

[52] U.S. Cl. ..... 256/65; 256/69; 256/19; 256/59; 49/394; 49/460

[58] Field of Search ..... 256/59, 65, 66, 256/68, 69, 19; 403/205, 169; 49/381, 394, 460

[56] References Cited

U.S. PATENT DOCUMENTS

| | | | |
|---|---|---|---|
| 634,066 | 10/1899 | Parker et al. | 49/396 |
| 1,192,592 | 7/1916 | Winter | 49/381 |
| 2,767,494 | 10/1956 | Peterson | 49/394 X |
| 3,342,457 | 9/1967 | Bobrowski | 256/65 X |
| 4,201,411 | 5/1980 | Morgan | 49/381 X |
| 4,286,372 | 9/1981 | Batcheller | 256/65 X |
| 4,953,830 | 9/1990 | Weaver, III | 256/59 X |
| 5,161,784 | 11/1992 | Sader | 256/19 X |
| 5,170,996 | 12/1992 | Venegas, Jr. et al. | 256/69 |
| 5,192,054 | 3/1993 | Sharp | 256/65 X |
| 5,261,647 | 11/1993 | Venegas, Jr. et al. | 256/19 X |
| 5,303,900 | 4/1994 | Zulick, III et al. | 256/65 |
| 5,312,089 | 5/1994 | Venegas, Jr. . | |
| 5,354,037 | 10/1994 | Venegas, Jr. | 256/59 |
| 5,364,077 | 11/1994 | Venegas, Jr. et al. | 256/69 |
| 5,396,739 | 3/1995 | Venegas, Jr. | 256/69 X |
| 5,421,666 | 6/1995 | Spears | 403/169 X |
| 5,566,927 | 10/1996 | Venegas, Jr. | 256/59 |

FOREIGN PATENT DOCUMENTS

| | | | |
|---|---|---|---|
| 1479596 | 5/1989 | Russian Federation | 256/65 |
| WO8809857 | 12/1988 | WIPO | 403/205 |

*Primary Examiner*—Lynne H. Browne
*Assistant Examiner*—John Cottingham
*Attorney, Agent, or Firm*—Gifford, Krass, Groh, Sprinkle, Anderson & Citkowski, PC

[57] ABSTRACT

A knock down gate assembly generally formed by two spaced apart vertical rails surrounded by a removable and replaceable polymerized sheathing and supported in an upright position by a removable and replaceable base support. A horizontal rail is removably engaged with the vertical rails by slip-on structural fittings. The horizontal rail is also surrounded by a removable and replaceable polymerized sheathing. Both the base structures and the slip-on structural fittings are secured to the vertical and horizontal rails through the respective polymerized sheathing by set screws. The present invention provides a knock down hand rail with gate assembly that is formed of both metal and plastic. The assembly is readily and easily assembled and disassembled. The assembly is maintenance free and requires no paint or other upkeep. The hand rail with gate assembly can readily be assembled anywhere or disassembled to form a different hand rail with gate structure configuration or to add more rails to the structure. Further, the hand rail with gate assembly can be readily disassembled to change the polymerized sheathing for the purpose of changing colors of the rail assembly or adding/subtracting signage provided on the structure.

10 Claims, 2 Drawing Sheets

PEOPLE GATE

RELATED APPLICATION

This application is a continuation-in-part of U.S. patent application Ser. No. 08/870,101 filed Jun. 5, 1997 entitled "Hand Rail System."

BACKGROUND OF THE INVENTION

I. Field of the Invention

The present invention is directed to a knock down gate rail assembly. More particularly, the present invention relates to a gate adapted to be combined with a hand rail system having a polymerized sheath extending about the rails of the assembly and further including a gate pivotable about itself to allow access to a guarded area.

II. Description of the Relevant Art

Typically, a hand rail assembly is often formed of metal bars having horizontal and vertical rails permanently affixed to each other to create a hand rail system. A disadvantage of these previously known structures is that the metal rail may rust from being exposed to the environment. A further disadvantage of a metal hand rail is that any damage done to a single rail will cause irreparable damage to the entire hand rail assembly. The whole assembly must then be replaced or repainted to prevent the metal from rusting.

A still further disadvantage of these hand rail assemblies is that the gate provided to allow access to the guarded area is also generally formed of metal bars having horizontal and vertical rails permanently affixed to each other to create a gate. Like the hand rail, the gate metal may rust from being exposed to the environment. A further disadvantage of a metal gate is that it may readily separate from the metal hand rail causing damage to the assembly. The gate must then be replaced or repainted to prevent the metal from rusting.

A still further disadvantage of these previously known hand rail assemblies with gates is that once assembled the hand rail is a permanent fixture. Therefore, parts of the hand rail that may be structurally damaged cannot readily be removed and replaced. Nor can additional gates be added or location change of the gate assembly be made without replacing the whole hand rail system.

SUMMARY OF THE PRESENT INVENTION

The present invention provides a hand rail assembly with gate which overcomes the disadvantages of these previously known hand rail assemblies. The hand rail assembly of the present invention is formed of two spaced apart vertical rails supported in an upright position by a removable and replaceable base preferably affixed to the ground.

A horizontal rail is removably engaged with the vertical rails and positioned above the base. A third vertical rail is disposed between the spaced apart vertical rails and supported in an upright position by the horizontal rail. This third vertical rail acts as a locking mechanism for the hand rail gate assembly of the present invention.

Each rail of the present invention is surrounded by removable and replaceable polymerized sheathing. The polymerized sheathing protects the metal rails from the environment, thereby eliminating the need to repaint or replace the hand rail assembly due to rust or other damage.

The assembly of the present invention can be used in many applications both indoor and out. The hand rail with gate assembly can be readily assembled anywhere. The assembly can also readily be disassembled to form a different hand rail with gate structure configuration or to add more rails or gates to the structure. Further, the hand rail with gate can be readily disassembled to change the plastic sheathing for the purpose of changing colors of the rail or adding/subtracting signage provided on the structure. This is advantageous when using the structure in an auditorium setting. The ability to color code railings with seatings makes it easier on attendants to find their seats during a game or show.

Since the hand rail with gate assembly of the present invention may be readily disassembled, slip-on structural fittings are provided to removably engage the horizontal rail to the vertical rails.

The hand rail with gate assembly of the present invention also provides for access to an inner area being guarded. The hand rail with gate assembly of the present invention does so by being pivotable about one of the vertical rails supported by a base. Thus, the hand rail assembly with gate acts as a pivoting gate that may be locked in an opened or closed position.

In other preferred embodiments, a plurality of vertical and horizontal rails surrounded by polymerized sheathing and engaged by slip-on structural fittings can be used. These and other objects, advantages and features of the invention will become apparent upon review of the following specification in conjunction with the drawings.

BRIEF DESCRIPTION OF THE DRAWINGS

The present invention will be more fully understood by reference to the following detailed description of the preferred embodiments of the present invention when read in conjunction with the accompanying drawing, in which like reference characters refer to like parts throughout the views and in which.

DETAILED DESCRIPTION OF THE PREFERRED EMBODIMENT

Figure 1:
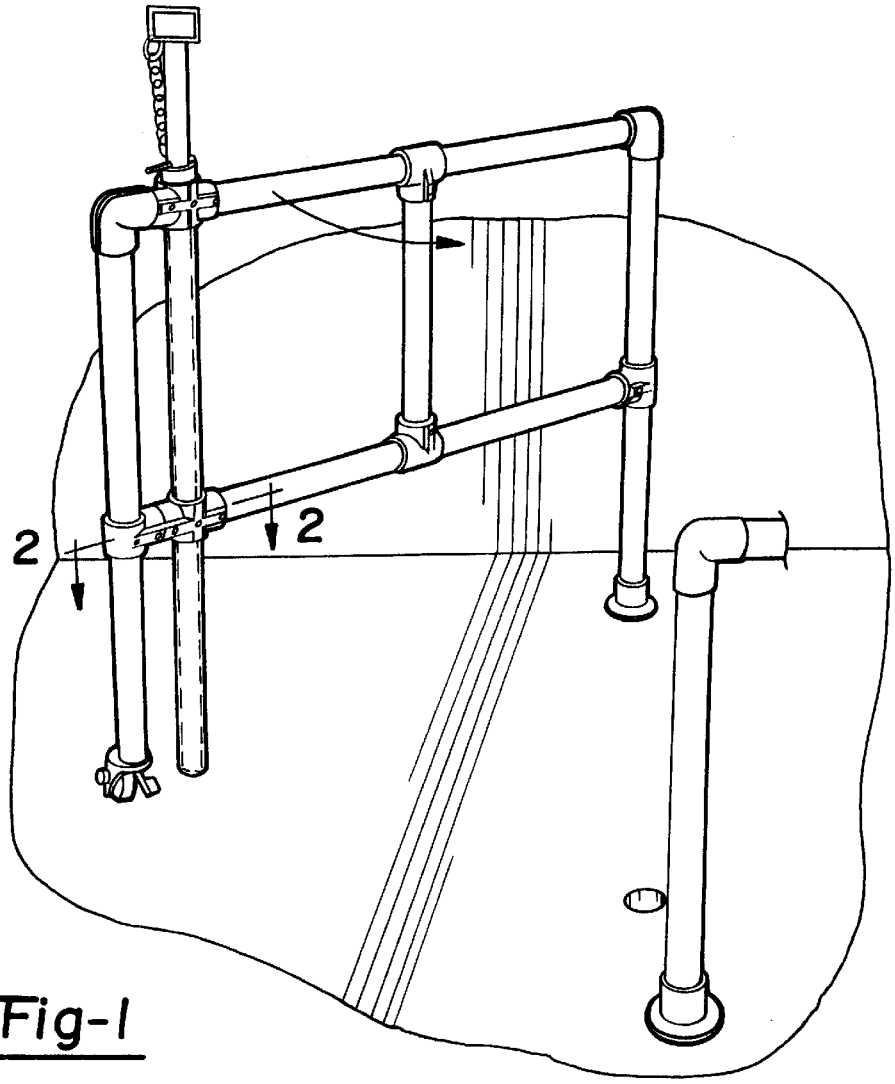
FIG. 1 is a perspective view illustrating a preferred embodiment of the present invention in an open position.

With reference to FIG. 1, a preferred embodiment of the hand rail with gate assembly 10 of the present invention is there shown in an open position.

The hand rail gate assembly 10 is preferably formed of two spaced apart vertical rails 12, 14 supported in an upright position by removable and releasable base structures 16, 18. By way of example, vertical rail 12 is removably and replaceably affixed to the ground 20 by base 16. Vertical rail 14 is supported in an upright position by base 18 that is rotatable between an open (shown) and closed position of gate assembly 10. This is accomplished by providing base structure 18 with a lock and wheel mechanism 22, 24.

Figure 2:
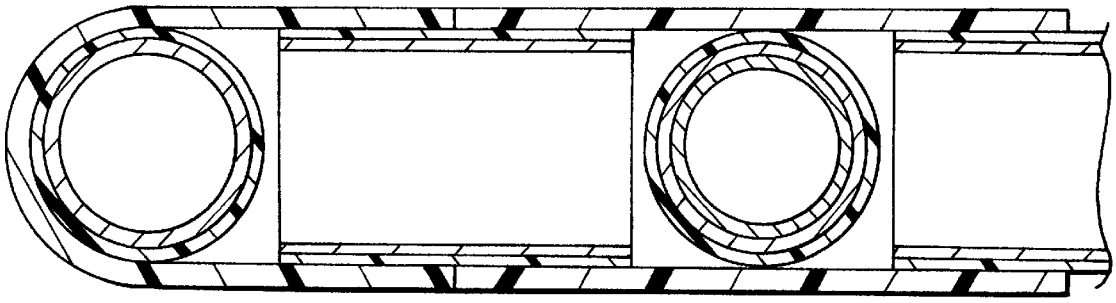
FIG. 2 is a cross-sectional view along lines 2—2 of FIG. 1.
Figure 3:
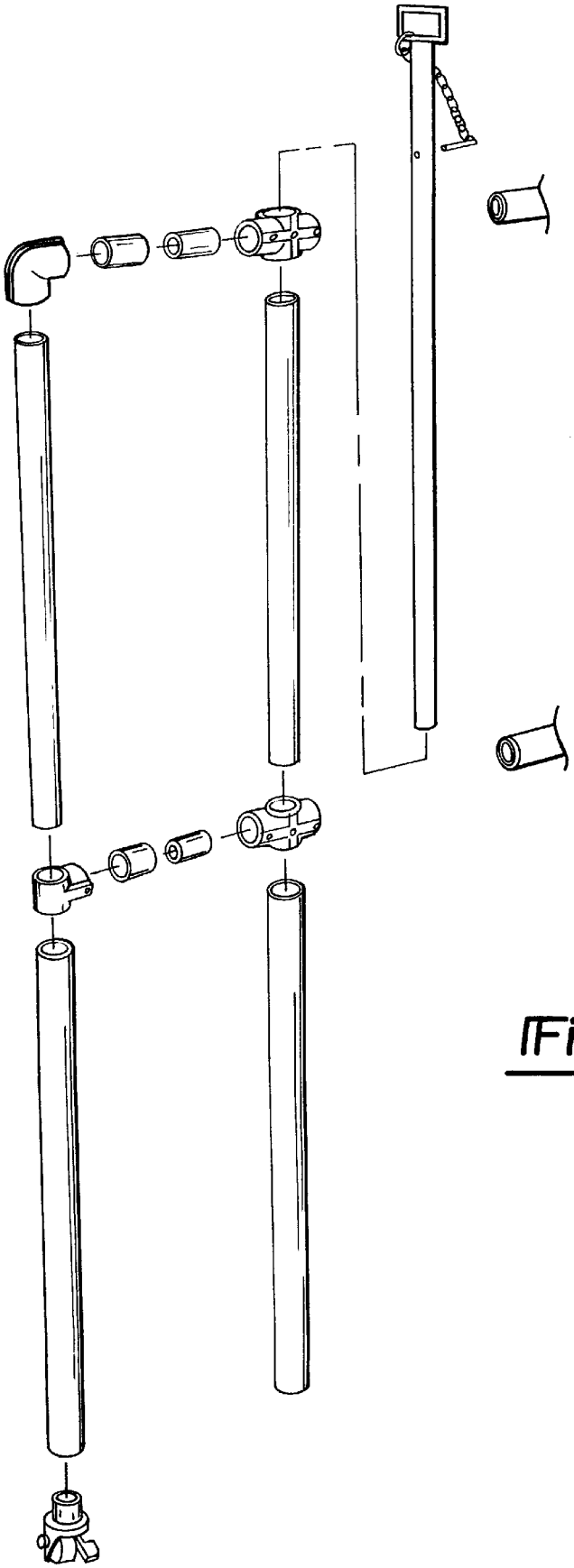
FIG. 3 is a partially exploded view of a preferred embodiment of the hand rail with gate assembly of the present invention.

As best shown in FIGS. 2 and 3, vertical rails 12, 14 are surrounded by removable and replaceable polymerized sheathing 26,28. Polymerized sheathing 26, 28 has an interior diameter 30, 32 equal to or greater than the outer diameter 34, 36 of vertical rails 12, 14.

Horizontal rail 38 is removably engaged with spaced apart vertical rails 12, 14 by L-shaped slip-on structural fittings 40, 42 at a position above base structure 16, 18. Horizontal rail 38 is also surrounded by removable and replaceable polymerized sheathing 44 having an inner diameter equal to or greater than the outer diameter of horizontal rail 38.

A third vertical rail 46 is disposed between spaced apart vertical rails 12, 14 and supported in an upright position by horizontal rail 38. In a preferred embodiment, vertical rail 46 acts as a locking mechanism for the gate assembly 10. With reference to FIG. 3, vertical rail 46 is slip fit into vertical rail 48. Both rails 46, 48 are then surrounded by removable and replaceable polymerized sheathing 50 having an inner diameter equal to or greater than the outer diameter of vertical rail 48. Vertical rail 46, 48 and polymerized sheathing 50 are removably engaged to horizontal rail 38 by a cross-shaped structural fitting 52. Vertical rail 46 preferably extends beyond the length of vertical rail 48 and polymerized sheathing 50 to lock gate assembly 10 in a closed position by extending into opening 54 of the ground 20 as shown in FIG. 1. Vertical rail 46 is equipped with a handle 56 at the opposite end to aid in sliding vertical rail 46 along a vertical axis to move the gate in an open or closed position. A locking mechanism 58 such as a pin is provided to fit within a hole 60 at a point along vertical rail 46 to lock vertical rail 46 in an open position as shown in FIG. 1. A chain 62 may be provided to attach pin 58 to handle 56 to prevent losing the pin 58.

A second horizontal rail 64 may be provided for additional structural support of gate assembly 10. Horizontal rail 64 is surrounded by removable and replaceable polymerized sheathing 66 having an inner diameter equal to or greater than the outer diameter of horizontal rail 64. Horizontal rail 64 is preferably disposed between vertical rails 12, 14 at a point below horizontal rail 38. Horizontal rail 64 is removably engaged with vertical rails 12, 14 by T-shaped slip-on structural fittings 68, 70 and with vertical rail 46 by cross-shaped slip-on structural fitting 72.

A third vertical rail 74 in conjunction with horizontal rail 64 may be added for structural support of gate assembly 10. Vertical rail 74 is preferably surrounded by removable and replaceable polymerized sheathing 76 having an inner diameter equal to or greater than the outer diameter of vertical rail 74. Vertical rail 74 is preferably disposed between vertical rail 46 and outer vertical rail 12. Vertical rail 74 is supported in an upright position between horizontal rails 38, 64 and is removably engaged to these rails by T-shaped slip-on structural fittings 78, 80.

With reference to FIGS. 2 and 3, T-shaped structural fitting 70 and cross-shaped structural fitting 72 are shown removably attached to vertical rails 14, 46 by set screws 82. L-shaped and T-shaped slip-on structural fittings 70, 72 preferably have inner diameters 84, 86 equal to or greater than the outer diameter 88, 90 of polymerized sheathing of vertical rails 14,46 respectively. Set screws 82 then extend through T-shaped and cross-shaped slip-on structural fittings 70, 72 beyond polymerized sheathing 28, 50 to be secured to inner metal rail 14, 48. This is typical of all slip-on structural fittings as described above. The slip-on structural fittings are preferably Hollaender structural fittings manufactured by the Hollaender Manufacturing Company, Cincinnati, Ohio.

Typical assemblage of the preferred embodiment of the present invention is shown in FIG. 3 where vertical rail 46 is slipped through structural fitting 52 into vertical rail 48 followed by polymerized sheathing 50 and secured by set screws 82. Horizontal rail 38 is then slip fit into polymerized sheathing 44 and secured in position by cross-shaped structural fitting 52 with set screws 82. Vertical rail 14 is slip fit through polymerized sheathing 28 and secured parallel to vertical rail 46 by L-shaped structural fitting 42 with appropriate set screws. Locking mechanism 18 slip fits within interior of vertical rail 14.

If additional horizontal rail 64 is to be used, then rail 64 is slip fit within polymerized sheathing 66 and supported in position by corresponding T-shaped structural fitting 70 that has been slip fit about polymerized sheathing 28 and X-shaped slip-on structural fitting 72 that has been slip fit about polymerized sheathing 50. Structural fittings 70, 72 are set in place by set screws 82.

FIG. 1 shows the gate assembly 10 of the present invention in an open position with vertical rail 46 locked in an upward position by pin 58. In this example, the gate assembly 10 swings about vertical rail 12.

To close gate assembly 10, the assembly is rotated about wheel 24 to a point matching hand rail assembly 92. Vertical rail 46 is moved upward by handle 56 and pin 58 is removed. Vertical rail 46 then drops down into hole 54 in the ground 20, locking gate assembly 10 in a closed position.

Alternative embodiments of the present invention may involve use of several horizontal and vertical rails extending to create an elongated hand rail with gate assembly 10. It is envisioned that each vertical rail will be removably supported to the ground by a base or structure if necessary. Moreover, each additional horizontal rail and vertical rail are preferably surrounded by removable and replaceable polymerized sheathing and supported to each other by removable slip-on structural fittings conforming to any shape necessary to create the overall structural shape of the hand rail with gate assembly of the present invention. That is, the hand rail with gate assembly of the present invention may extend linearly, triangularly, circularly, or any other shape that may be reasonably configured.

The above description is considered that of the preferred embodiment only. Modifications of the invention may occur to those of ordinary skill in the art. Therefore, it is understood that the embodiment shown in the drawing and described above is merely for illustrative purposes and is not intended to limit the scope of the invention.

I claim:

1. A knock down gate assembly comprising:

a pre-existing hand rail assembly adapted to be a knock down hand rail system by rearranging said rails;

a gate comprising a vertical rail removably disposed with said hand rail assembly;

removable and replaceable polymerized sheathing surrounding said vertical rail having an interior diameter equal to or greater than the outer diameter of said vertical rail;

said vertical rail extending below the length of polymerized sheathing for releasably securing said gate assembly in place and above said hand rail assembly from a handle;

means for removably engaging said gate to said hand rail assembly; and means for locking said gate in an open or closed position upon rotation of said hand rail assembly.

2. The invention as defined in claim 1, wherein said pre-existing hand rail assembly further comprises:

two spaced apart vertical rails;

means for supporting said vertical rails in an upright position;

a horizontal rail removably engaged with said vertical rails and positioned above said support means;

removable and replaceable polymerized sheathing surrounding each of said vertical rails having an interior diameter equal to or greater than the outer diameter of each of said vertical rails;

removable and replaceable polymerized sheathing surrounding said horizontal rail having an interior diameter equal to or greater than the outer diameter of said horizontal rail; and means for removably engaging said horizontal rail to said vertical rails.

3. The invention as defined in claim 2 wherein said vertical rail of said knock down gate assembly is removably engaged between said two spaced apart vertical rails of said hand rail assembly.

4. The invention as defined in claim 3, said means for removably engaging said gate to said hand rail assembly comprising a cross-shaped member formed of polymerized sheathing and having a hollow interior;

wherein two legs of said cross-shaped member have an interior profile identical to the exterior profile of said vertical rail of said gate assembly and two opposing legs have an interior profile identical to the exterior profile of said horizontal rail of said hand rail assembly; each of said interior profiles having a diameter equal to or greater than the exterior diameter of said polymerized sheathing surrounding each of said horizontal and vertical rails.

5. The invention as defined in claim 2, said means for locking said gate in an open position comprising a lock for supporting said vertical rail of said gate in an upward position above said horizontal rail of said hand rail assembly and a hole within the ground for seating said vertical rail of said gate in a closed position, said hole having a diameter equal to said vertical rail.

6. The invention as defined in claim 2, said known down gate assembly further comprising means for rotating said gate and hand rail assembly between an open and closed position, said rotating means comprising a lock and wheel mechanism extending from one said two spaced apart vertical rails of said hand rail assembly.

7. The invention as defined in claim 2, said means for removably engaging said horizontal rail to said vertical rails comprising an L-shaped member formed of polymerized sheathing and having a hollow interior;

wherein each leg of said L-shaped member has an interior profile identical to the exterior profile of said horizontal and vertical rails; said interior profile having a diameter equal to or greater than the exterior diameter of said polymerized sheathing surrounding each of said horizontal and vertical rails.

8. The invention as defined in claim 2 and further comprising a second horizontal rail spaced apart from said horizontal rail of said hand rail assembly, said second horizontal rail extending between said spaced apart vertical rails.

9. The invention as defined in claim 8 and further comprising means for removably engaging said second horizontal rail to said spaced apart vertical rails.

10. The invention as defined in claim 9, said means for removably engaging said second horizontal rail to said spaced apart vertical rails comprising a T-shaped member formed of polymerized sheathing and having a hollow interior, wherein each leg of said T-shaped member has an interior profile identical to the exterior profile of said horizontal and vertical rails; said interior profile having a diameter equal to or greater than the exterior diameter of said polymerized sheathing surrounding each of said horizontal and vertical rails.

* * * * *